US009010313B2

(12) United States Patent
Mikulec

(10) Patent No.: US 9,010,313 B2
(45) Date of Patent: Apr. 21, 2015

(54) COOKERY AIR PURIFICATION AND EXHAUST SYSTEM

(71) Applicant: Conrad S. Mikulec, Buffalo, NY (US)

(72) Inventor: Conrad S. Mikulec, Buffalo, NY (US)

( * ) Notice: Subject to any disclaimer, the term of this patent is extended or adjusted under 35 U.S.C. 154(b) by 344 days.

(21) Appl. No.: 13/650,100

(22) Filed: Oct. 11, 2012

(65) Prior Publication Data

US 2013/0087134 A1 Apr. 11, 2013

Related U.S. Application Data

(60) Provisional application No. 61/627,302, filed on Oct. 11, 2011.

(51) Int. Cl.
*F24C 15/20* (2006.01)

(52) U.S. Cl.
CPC ..... *F24C 15/2021* (2013.01)

(58) Field of Classification Search
USPC ..... 126/299 D, 299 R, 25 C; 454/49
See application file for complete search history.

(56) References Cited

U.S. PATENT DOCUMENTS

| | | | | |
|---|---|---|---|---|
| 4,756,839 | A | 7/1988 | Curzon et al. | |
| 4,813,487 | A | 3/1989 | Mikulec et al. | |
| 4,979,572 | A | 12/1990 | Mikulec | |
| 5,351,760 | A * | 10/1994 | Tabor, Jr. | 169/65 |
| 5,992,531 | A | 11/1999 | Mikulec | |
| 7,303,024 | B2 | 12/2007 | Mikulec | |

* cited by examiner

*Primary Examiner* — Alfred Basichas
(74) *Attorney, Agent, or Firm* — Lakeview Patents, LLC.

(57) ABSTRACT

An air filtration and exhaust system is described. The system comprises a microcontroller, a power supply, and a series of sensors that detect the presence of airborne contaminants such as ultra fine particles, smoke, natural gas and radon gas. In the presence of these airborne contaminants, the system is designed to inactivate and prevent operation of nearby food preparation appliances. Once these contaminants have been safely removed, the operation of these appliances is restored. In addition, the ventilation system may be equipped with a purification subassembly, which safely and efficiently removes such containments from the area. The system may also comprise an alarm that is activatable in the presence of these contaminants.

70 Claims, 10 Drawing Sheets

COOKERY AIR PURIFICATION AND EXHAUST SYSTEM

CROSS-REFERENCE TO RELATED APPLICATION

The present application claims priority from U.S. Provisional Application Ser. No. 61/627,302 filed Oct. 11, 2011.

BACKGROUND OF THE INVENTION

1. Field of the Invention

The present invention relates to air purification systems and more particularly, to an air purification and ventilation system for use with cooking appliances.

2. Prior Art

Ventilation and purification systems for stoves and other cooking appliances are well known. Many different types of cooking appliances produce smoke, carbon monoxide, natural gas and ultra fine particles that are released into ambient air. In addition, food preparation and cooking activities could also release microorganisms and viruses into the air. Such contaminants could adversely affect the health of the person or persons present in the kitchen or food preparation area. Often, it is considered beneficial to utilize some type of ventilation system to evacuate these air borne contaminants.

In kitchens, most known venting arrangements take the form of a ventilation hood which is fixed above a cooking surface and which can be selectively activated to evacuate the contaminated air. However, operating a kitchen appliance, such as an oven, stove, or toaster in the presence of these contaminants could result in not only contamination of the food being prepared, but also may be detrimental to the health of the person in the kitchen. Ultra fine particles and other particulate matter, comprising both organic and inorganic based matter, are often given off by these appliances and could easily be inhaled or become embedded within food. These particles typically range in size from about 1 nm to about 100 nm and thus, because of their small size, may easily travel deep within lung tissue and undergo interstitialization within the body.

Exposure to ultra fine particles, even though these particles may not be toxic to the body, have been known to cause oxidative stress or inflammatory mediator release, which could over time, induce lung disease or other health problems. Other contaminants, such as natural gas, might leak from the stove or oven and could result in an explosion or fire.

Operating these kitchen appliances in the presence of these contaminants therefore, is not desirable. In addition, the presence of smoke or a gas such as natural gas or carbon monoxide could indicate a potential fire or other potential hazard. Therefore, continued use of cooking appliances, particularly those that give off heat or produce a flame, are not desirable and could potentially lead to a fire or explosion.

It is therefore desirable to remove these airborne containments, particularly from the food preparation area. In addition, it is desirable to control the operation of various cooking appliances in the presence of these containments. Such airborne contaminants could contaminate the food being prepared as well as damage lung tissue.

SUMMARY OF THE INVENTION

The present invention provides a ventilation hood system designed to operate in conjunction with other appliances in a food preparation area such as a kitchen. The ventilation system is responsive to the presence of smoke, radon gas, carbon monoxide gas, natural gas, and ultra fine particulate matter among others. In the presence of these airborne contaminants, the system is designed to inactivate and prevent operation of nearby food preparation appliances. Once these contaminants have been safely removed, the operation of these appliances is restored. In addition, the ventilation system may be equipped with a purification subassembly, which safely and efficiently removes such containments from the area.

The ventilation system comprises a series of sensors that detect the presence of various airborne contaminants including, but not limited to, smoke, natural gas, carbon monoxide and ultra fine particles. These sensors are electrically connected to a microcontroller or microprocessor that controls the operation of the stove or oven and other food preparation appliances which might be connected to nearby electrical outlets in the area. An impellor or a fan, which is electrically connected to the microcontroller or a microprocessor, is positioned within the ventilation hood, preferably within the main body or plenum of the ventilation hood. The fan operates at variable speeds thus generating a wide range of air velocities designed to evacuate various volumes of contaminated air from the building and/or circulate the contaminated air through the filtration subassembly.

The ventilation system comprises a stove shutoff mechanism or mechanisms designed to make a stove and/or oven inoperable. The shutoff mechanism is designed to work with either an electrical or gas powered stove to shutoff the electricity and/or gas supply. An alarm may be provided such that an audible or visual indication is given when contaminants are detected. The alarm may be configured to contact a first responder such as a fire station, police station or other remote location.

In addition, the ventilation system may work in conjunction with a fire suppression system positioned either in the ventilation hood or within the general food preparation area. The ventilation system of the present may be connected to the fire suppression system such that when smoke, natural gas, carbon monoxide gas or excessive heat is detected, the fire suppression system is activated.

DETAILED DESCRIPTION OF THE PREFERRED EMBODIMENTS

Figure 1:
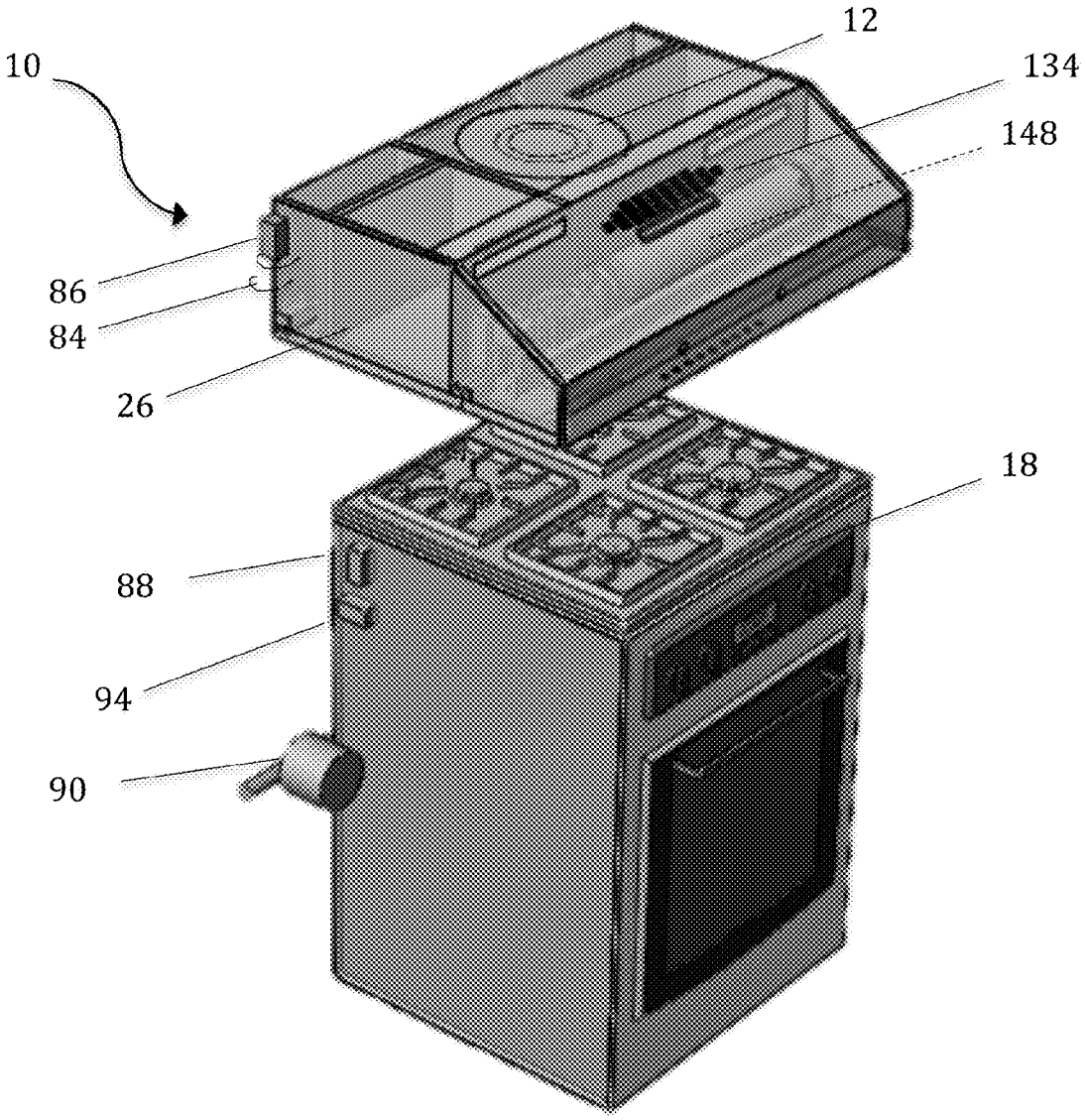
FIG. 1 illustrates a perspective view of an embodiment of the ventilation system of the present invention positioned within a range ventilation hood over a cooking range.

Now referring to the figures, FIGS. 1-4, 7-8, 9A, 9B, 10 and 11 illustrate embodiments of a ventilation system 10 of the present invention. The ventilation system 10 comprises a ventilation fan 12, a microcontroller 14 and a series of sensors 16 that are electrically connected to the microcontroller 14. The sensors 16 are designed such that they provide feedback to the microcontroller 14. The microcontroller 14 of the ventilation system 10 receives the various signals, monitors the data and acts on the data and information provided by the sensors 16 to control the flow of gas and electricity that powers a stove 18, surrounding electrical outlets 20, and food preparation appliances 22. These food preparation appliances 22 may include, but are not limited to, a toaster, a mixer, a blender, a toaster oven, a can opener and the like.

In addition, the ventilation system 10 may comprise an air filtration subassembly 24. As shown, the air filtration subassembly 24 is preferably positioned adjacent to the ventilation fan 12. In a preferred embodiment, the ventilation system 10 is designed to fit within a ventilation hood 26, more preferably, within a plenum portion 28 of the ventilation hood 26 of a cooking appliance 22 such as a stove or oven 18. Although it is preferred to position the system 10 within the plenum portion 28 of the ventilation hood 26 of the stove 18, the system 10 may be mounted to or within a ceiling such that it is positioned above the stove 18.

The term "stove" is herein defined as a portable or fixed apparatus that burns fuel, such as a gas or flammable liquid, or uses electricity to provide heat for the purpose of cooking or heating. The term "oven" is herein defined as a chamber that is heated through the burning of a fuel, such as a gas or flammable liquid, or uses electricity to provide heat for the purpose of cooking or heating. The term "range" is herein defined as a portable or fixed apparatus that burns fuel or uses electricity to provide heat for the purpose of cooking or heating. A "range" may comprise a multitude of burners and/or one or more ovens. The term "plenum" is herein defined as the space within the main body of a ventilation hood of a stove or oven. The plenum portion of the ventilation hood typically resides at the rear of the ventilation hood. The term "canopy" is herein defined as the front portion of the ventilation hood of a stove or oven. The canopy portion of the ventilation hood typically has a downward angle.

As shown in FIGS. 1-3, 9A and 9B, the fan 12 is preferably positioned within and about the center of the plenum portion 28 of the ventilation hood 26. An air intake opening 30 is positioned along an exterior surface 32 (FIG. 6) of the fan 12. The fan 12 is designed such that contaminated air 34 enters through the air intake opening 30 of the fan 12. The contaminated air 34 is then either forced out a side hood opening 36, such as a back side hood opening as shown and/or is forced through the filtration subassembly 24, where the contaminated air 34 becomes purified. Alternatively, the system 10 may be designed with a left side door and/or a right side hood door and/or a top side hood door to allow for the opening 36 for the contaminated air 34 to exit.

Furthermore, although it is preferred that the fan 12 is positioned within the center of the plenum portion 28 of the ventilation hood 26, the fan 12 may be placed within a left side 42 or a right side 44 of the ventilation hood 26. In a preferred embodiment, the ventilation fan 12 provides an adjustable airflow of at least 5 cubic feet per minute (CFM) through the ventilation hood 26 and through the filtration subassembly 24.

Figure 6:
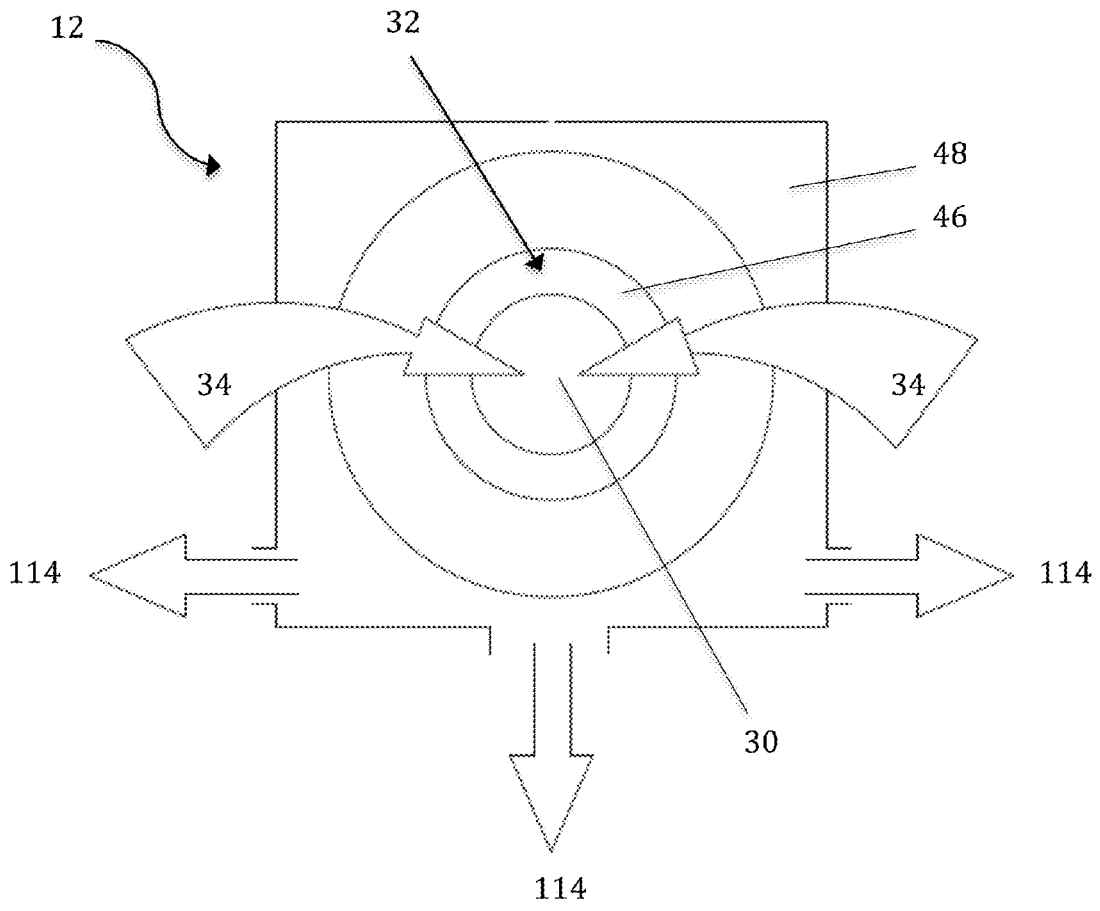
FIG. 6 is a schematic drawing of an embodiment of the air circulation caused by the movement of the impellor of the fan of the ventilation system of the present invention.
Figure 7:
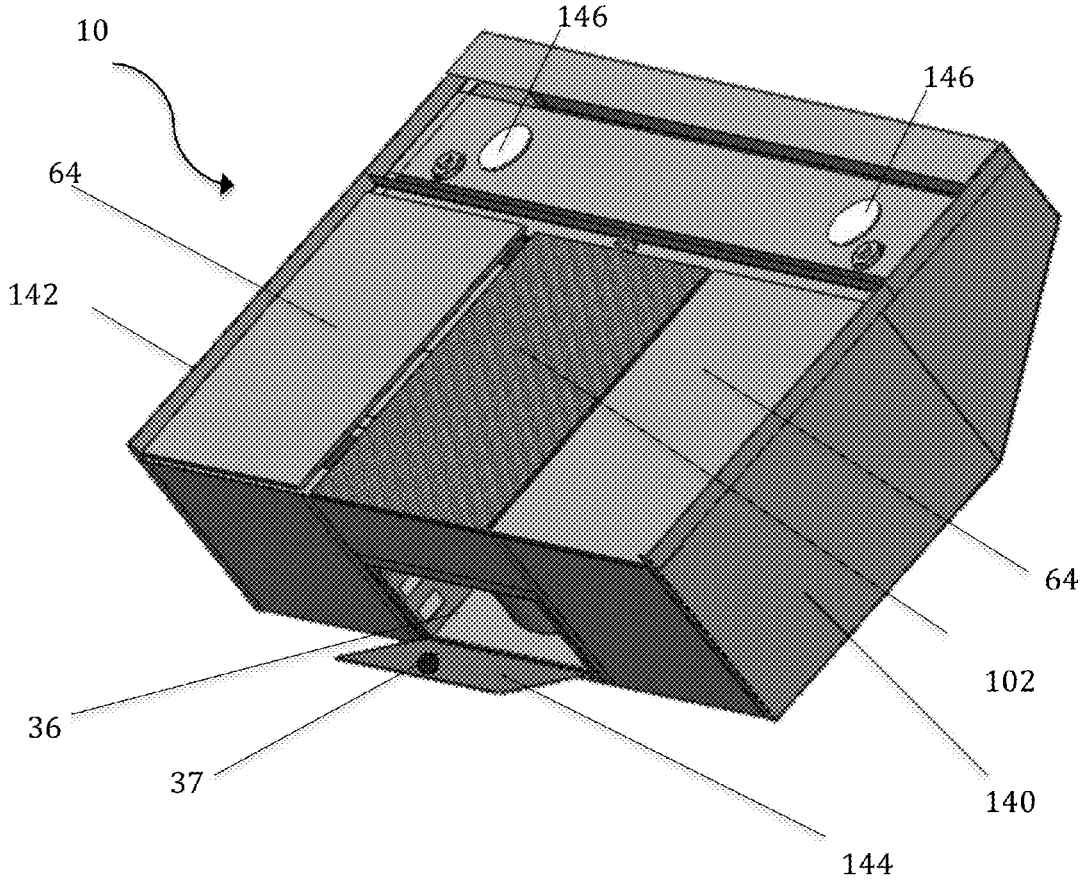
FIG. 7 illustrates a perspective view of an embodiment of the bottom side of the air filtration system of the present invention in a ventilation hood.
Figure 9A:
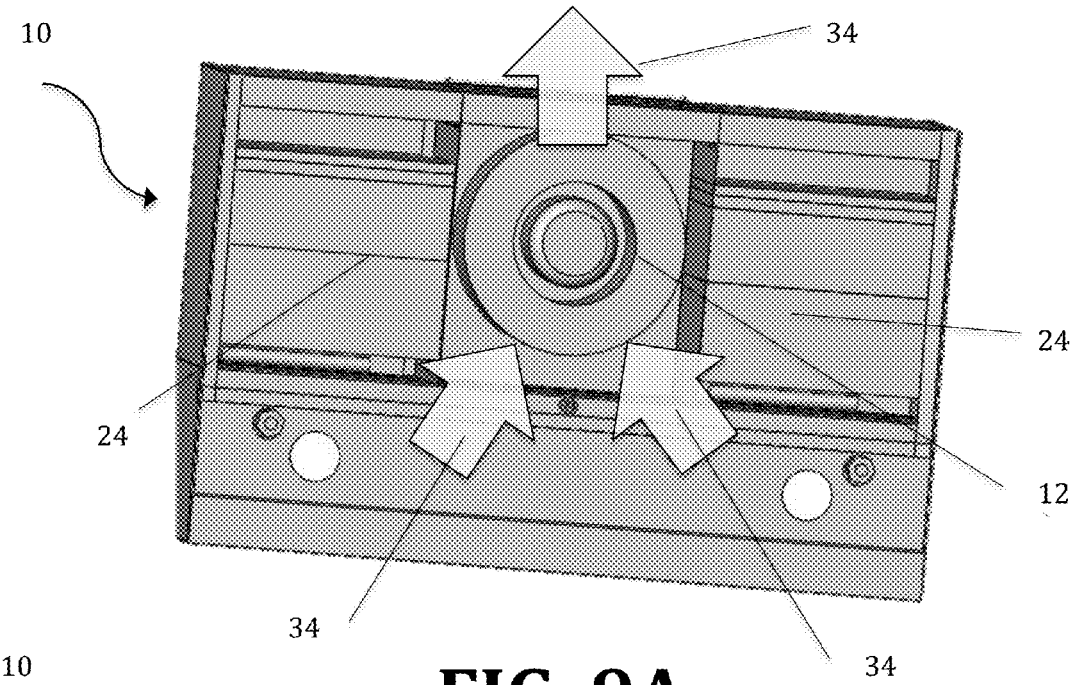
FIG. 9A illustrates an embodiment of the airflow through the system in which contaminated air is exited out a back door opening.
Figure 9B:
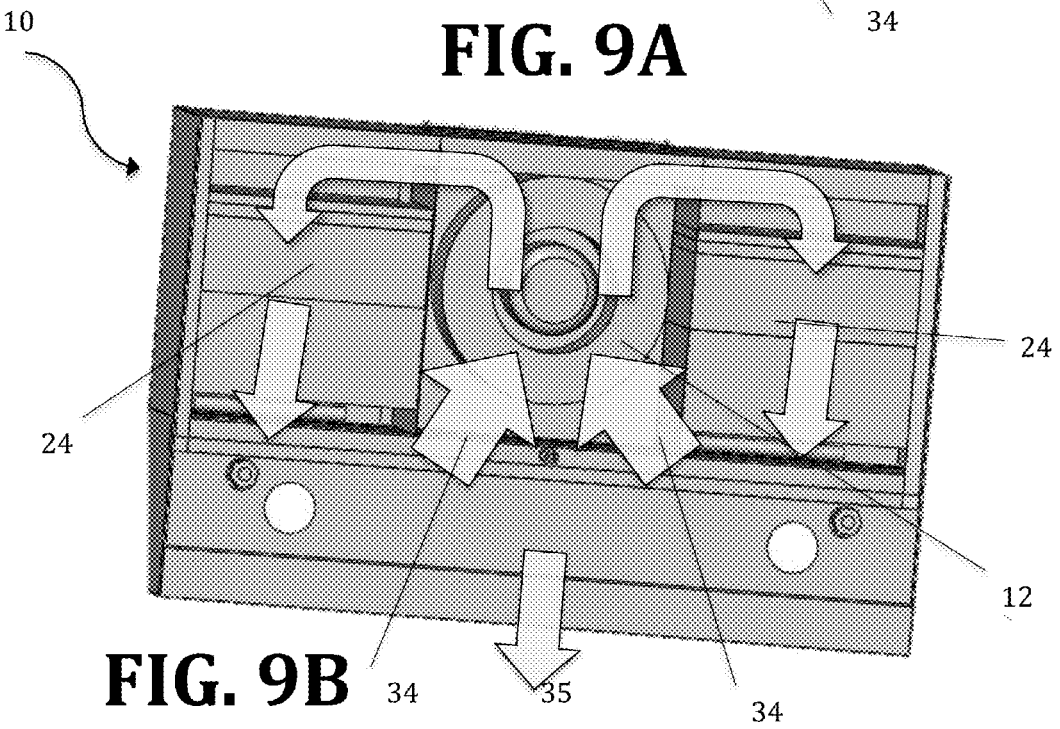
FIG. 9B illustrates an additional embodiment of the airflow through the system in which contaminated air flows through the filtration subassembly.

As shown in FIGS. 6 and 7, contaminated air 34 enters the air intake opening 30 and is either circulated through the filtration subassembly 24 and/or is exited out the side hood opening 36 of the ventilation hood 26 by an impellor 46 that resides within a fan housing 48. In a preferred embodiment, as shown in FIG. 9A contaminated air 34 enters the air intake opening 30 of the fan 12 and is immediately forced out of the ventilation hood 26 through the side door opening 36 by the impellor 46. Alternatively, as shown in FIG. 9B, contaminated air 34 enters the air intake opening 30 of the fan 12 and is circulated through the filtration subassembly removing undesirable particulates and contamination from the air. The contaminated air thus exits the ventilation hood 26 as purified air 35 into the food preparation area. As will be discussed in more detail, the airflow through the ventilation system 10 will be adjusted automatically by the microcontroller 14 based on the level of contaminants within the air 34.

Figure 3:
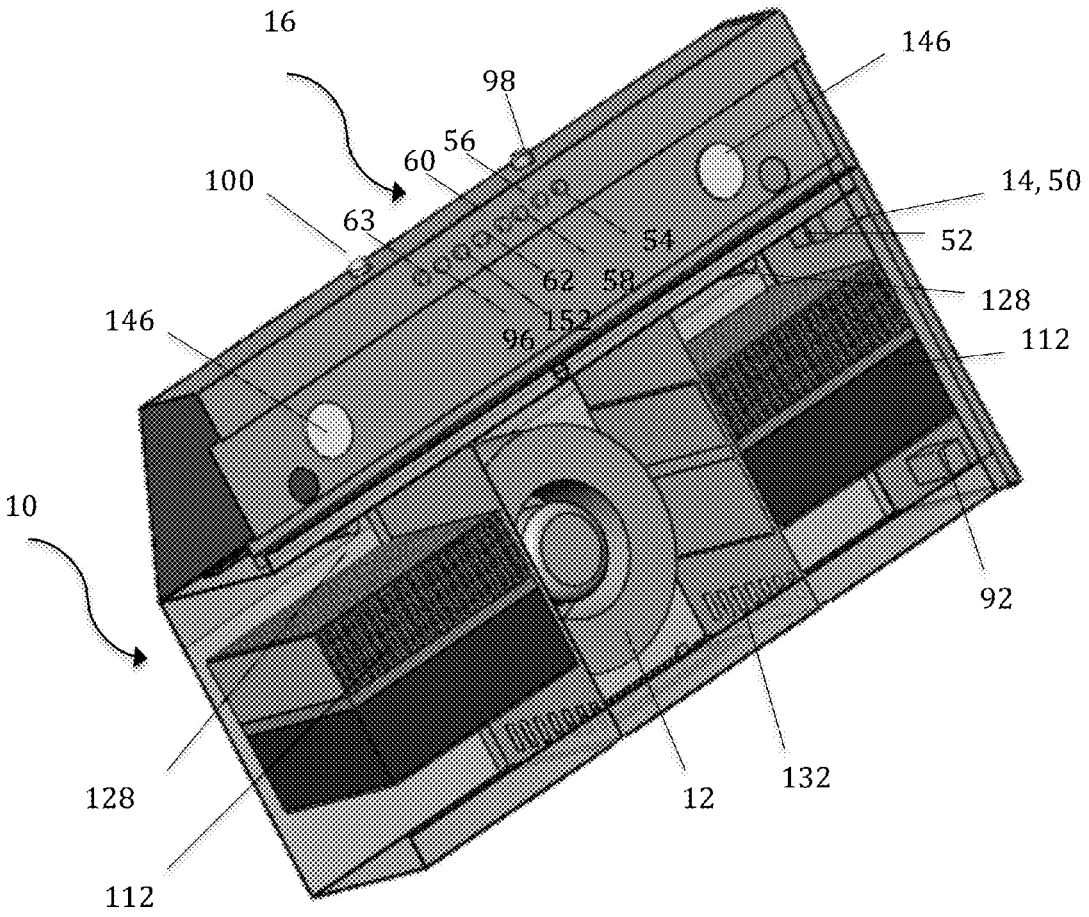
FIG. 3 is a partially broken perspective view taken the bottom of an embodiment of the ventilation system positioned within a range ventilation hood.

As illustrated in FIG. 3, the microcontroller 14 is preferably positioned within the plenum portion 28 of the ventilation hood 26, adjacent to the fan 12 and filtration subassembly 24. Alternatively, the microcontroller 14 may be positioned in a remote location within the food preparation area. The microcontroller 14 may also be electrically connected to digital memory such as random access memory (RAM), read only memory (ROM), and the like. An electronic data storage device (not shown) such as a hard drive, or the like, may also be removably connected to the microcontroller 14. Such electronic memory devices may work with the microcontroller 14 to provide data storage of various settings, operating parameters, programming instructions, as well as record historical parameters and operations performed by the system 10. Alternatively, a microprocessor 50 may be used instead of the microcontroller 14. Furthermore, the microcontroller 14 or microprocessor 50 may be controlled via a hard wire or a wireless connection.

Figure 11:
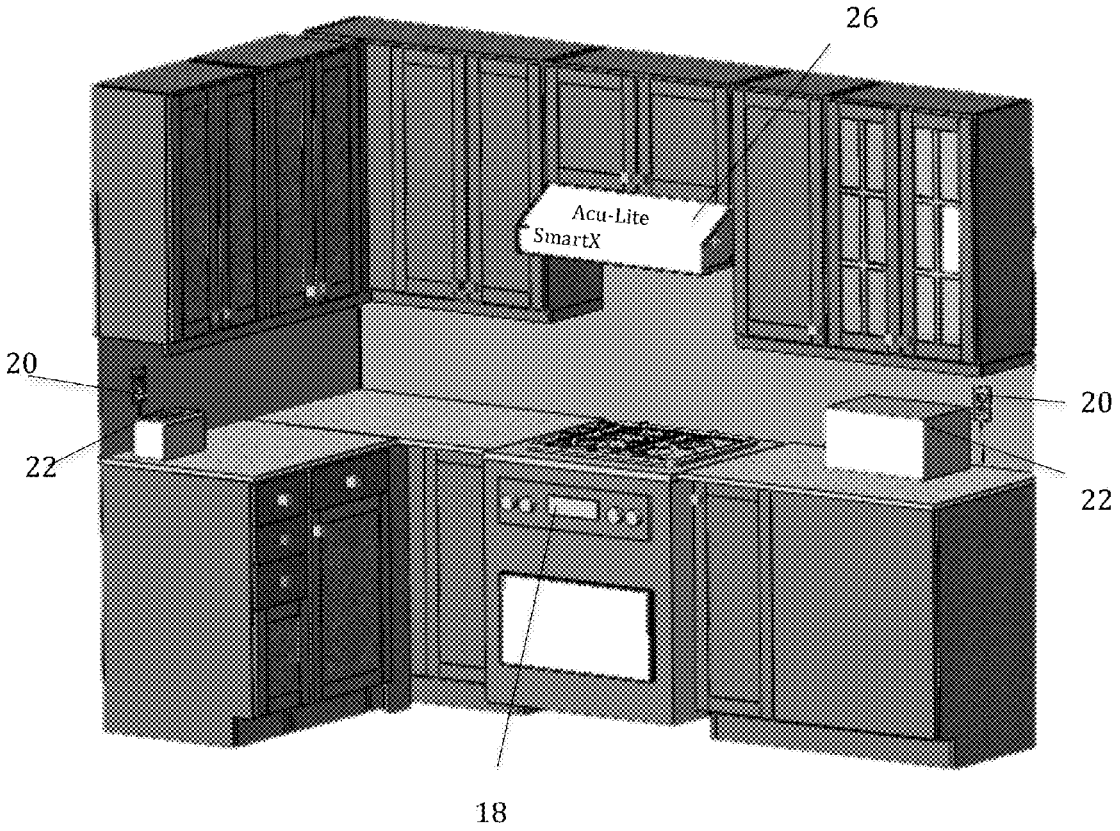
FIG. 11 shows a perspective view of an embodiment of the ventilation system of the present invention installed within a food preparation area.

The microcontroller 14 or microprocessor 50 acts as the central control unit for the system 10. Information and data received from the various sensors 16 is received and processed by the microcontroller 14. The microcontroller 14 or microprocessor in conjunction with previously programmed parameters and responses, may utilize the information received from the various sensors 16, to control the operation of the stove 18, fan 12, and other cooking appliances 22 that are connected to the electrical outlets 20 in the food preparation area. For example, if a response is received that is within acceptable operating parameters, operation of the cooking appliances 18, 22 will be allowed (FIG. 11). However, if a response is received that is not within acceptable operating parameters, operation of the cooking appliances 18, 22 will not be allowed. The system 10 is designed to continuously monitor the response of the sensors 16 and actively adjust operation of the appliances 18, 22 appropriately.

Figure 10:
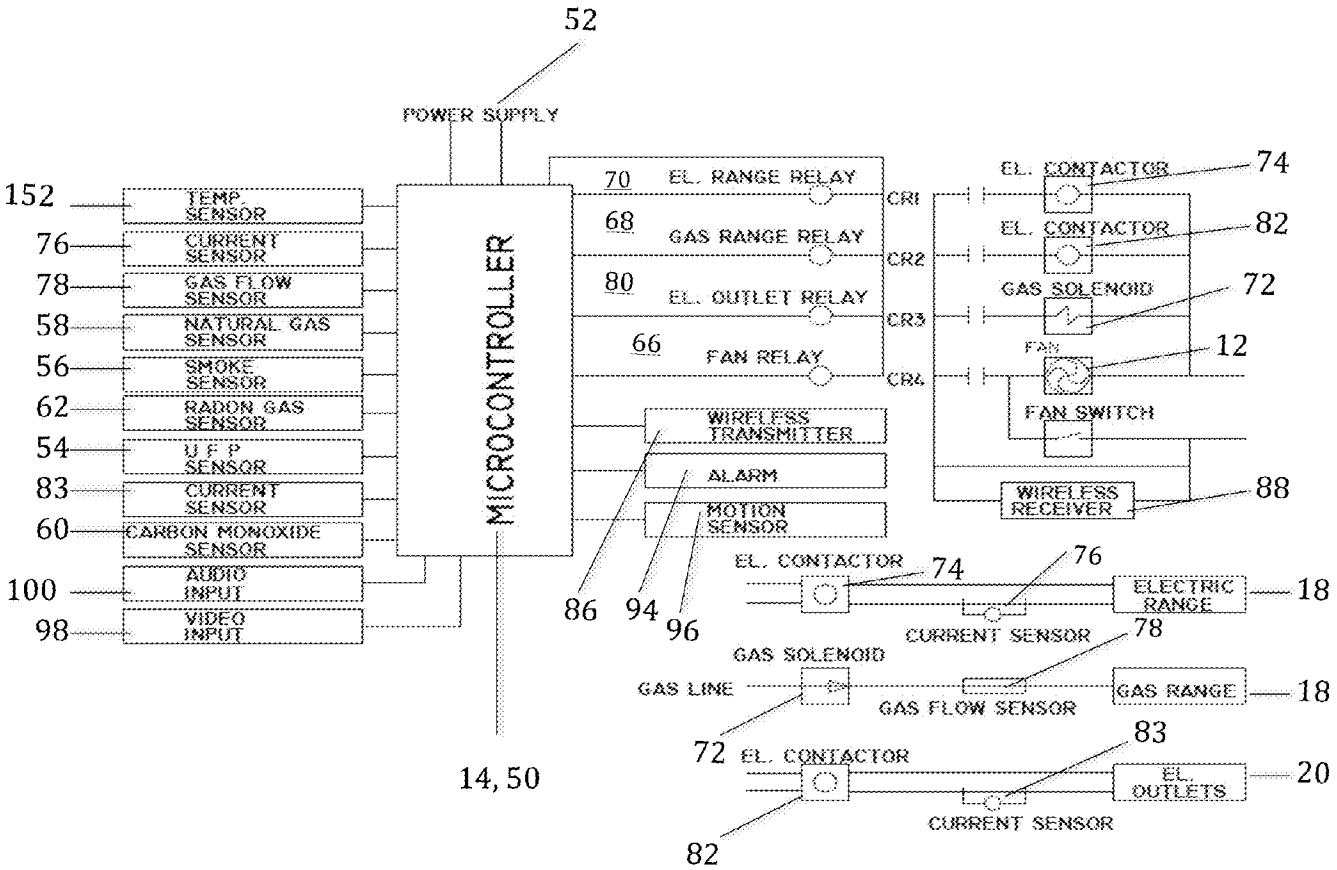
FIG. 10 is a schematic diagram showing the electrical connections comprising the ventilation system of the present invention.

The system 10 also comprises a power source 52 (FIGS. 3 and 10). The power source 52 is preferably positioned within the plenum portion 28 of the ventilation hood 26. The power source 52 is designed to provide electrical power to the microcontroller 14, the fan 12 and series of sensors 16 that comprise the system 10. In addition, the power source 52 may also provide electrical power to the filtration subassembly 24.

In a preferred embodiment, the power source 52 provides a direct current electrical power ranging from about 0.5 VDC to about 50 VDC, more preferably the power source 52 provides from about 1 VDC to about 10 VDC of electrical power 52. Alternatively, the power source 52 may provide an alternating current supply instead of a direct power supply. The power source 52 may be connected directly to an electric alternating current supply that is typically provided in a residential or commercial building worldwide, such as about 110-120V, having a frequency of about 50-60 Hz, or about 220-230V, having a frequency of about 50-60 Hz. In an alternate embodiment, an electrochemical cell (not shown) or an electrical generator (not shown) may be used to power the ventilation system 10 of the present invention.

Figure 2:
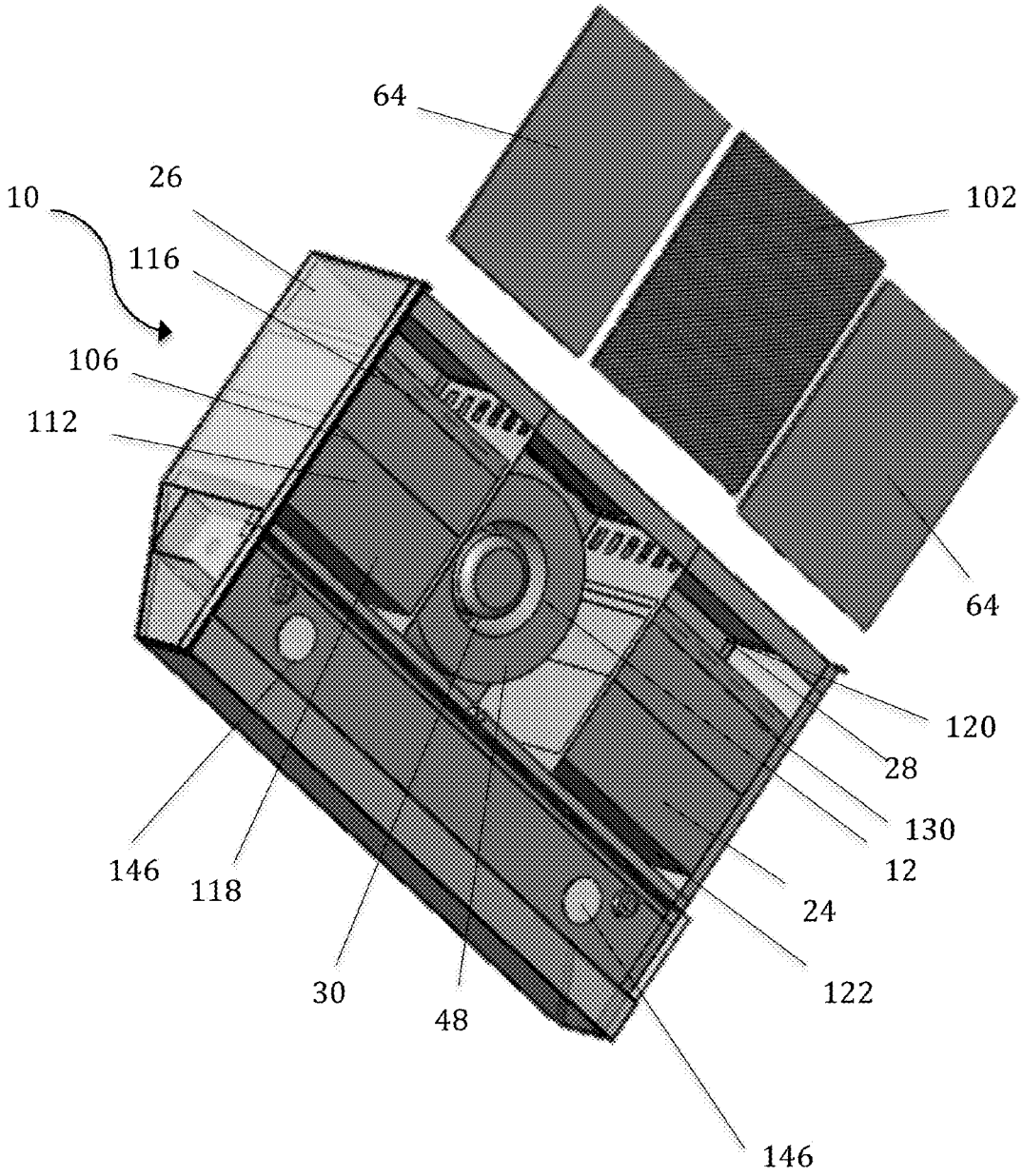
FIG. 2 shows a perspective view of the bottom side of the ventilation system positioned within the range ventilation hood.

As shown in FIGS. 3 and 10, an ultra fine particle (UFP) sensor 54 is provided within the ventilation hood 26. In addition to the UFP sensor 54, the system 10 may comprise a smoke sensor 56, a natural gas sensor 58, a carbon monoxide sensor 60, a radon gas sensor 62, and a photocatalytic sensor 63. In a preferred embodiment, the ultra fine particle sensor 54 is positioned such that it is exposed to ambient air within the food preparation area. The sensor 54 may be positioned through an opening of the ventilation hood 26 such as a ventilation hood side panel 64 as shown in FIGS. 2 and 3. Alternatively, the UFP sensor 54 may be positioned in a remote location of the food preparation area such as within a wall, ceiling or cabinet. In such cases, the sensor 54 is positioned such that at least a portion of the detector mechanism of the sensor 54 is exposed to ambient air within the food preparation area. The system 10 is designed to comprise at least one UFP sensor 54. Alternatively, the system 10 may comprise more than one UFP sensor 54 that may be positioned at various locations within the food preparation area, thus providing information pertaining the ultra fine particle content at multiple locations within a room at the same time or at various times intervals.

In a preferred embodiment, the microcontroller 14 or microprocessor 50 of the system 10 receives a signal from the UFP sensor 54. The response signal that is emitted by the UFP sensor 54 is read and analyzed by the microcontroller 14. The information received by the sensor 54 is then compared to a threshold value by the microcontroller 14. The threshold value is programmed within the microcontroller 14 of the system 10. The ultra fine particle threshold value is in direct proportion to the number of ultra fine particles per cubic unit of area in the ambient air. The threshold value may be reprogrammed and changed if desired. If the response signal from the UFP sensor 54 is determined, by the system 10, to be above the threshold value, the stove/oven 18 is rendered non-operational for a period of time. In a preferred embodiment, the gas and/or electrical power that operate the stove 18 are temporarily turned off. In addition, the electrical power provided by the nearby electrical outlets 20, is also shutoff for a period of time as well, thereby preventing operation of additional food preparation appliances 22 that are connected to the electrical outlets 20.

Furthermore, in the event that the response signal is determined to be above the ultra fine particle threshold level, the fan 12 is turned on (if not already on) and the speed of the fan 12 is increased, thereby increasing the volume of air that passes through the system 10. In a preferred embodiment, when the microcontroller 14 determines that the response signal from the sensor 54 to be above the threshold value, the speed of the fan 12 is maximized. Thus, by increasing the volume of air that passes through the system 10, the area is quickly rid of the airborne contaminants.

After a period of time, which has been programmed into the microcontroller 14, the response signal of the UFP sensor(s) 54 may be sampled again to determine if the signal is determined to equate to a particle level that is below the prescribed threshold level. Once the particle level has been determined to have decreased to a level below the predetermined threshold level, the gas and/or electricity operating the stove/oven 18 is allowed to flow.

In addition, electricity powering the electrical outlets 20 of the nearby food preparation appliances 22 is also turned back on, thereby making these appliances 22 operational. The signal that is emitted by the sensor or sensors 54 may be an electrical voltage, an electrical current, or combinations thereof. In a preferred embodiment, the threshold value may range from about 0.01 mV to about 100 mV.

Alternatively, the system 10 may operate without receiving a second signal from the sensor. In this case, the operation of the oven 18, surrounding electrical outlets 20 and appliances 22 is restored after a period of time. In a preferred embodiment, this period of time may range from about one second to about 60 seconds, during which time the fan 12 is operated, particularly at maximum speed to rid the air of contaminants.

In addition to the ultra fine particle sensor 54, as shown in FIGS. 3 and 10, the system 10 may comprise additional sensors 16, among these are the natural gas sensor 58, the carbon monoxide sensor 60, the radon gas sensor 62 and the smoke sensor 56. Similar to the UFP sensor 54, these additional sensors 56, 58, 60, and 62 are electrically connected to the microcontroller 14 or microprocessor 50 and power source 52. In an embodiment, these additional sensors 56, 58, 60, and 62 may also be positioned within the ventilation hood 26 such that their respective detector portions of the sensor are exposed to the ambient air of the food preparation area. In a further embodiment, the system 10 may comprise at least one of these additional sensors 56, 58, 60, 62, and 63. However, multiple sensors 56, 58, 60, 62, and 63 may be provided and positioned at remote locations within the food preparation area.

FIG. 10 illustrates an embodiment of an electrical circuit diagram of the system 10 of the present invention. In the embodiment shown, the UFP sensor 54, the smoke sensor 56, the natural gas sensor 58, the carbon monoxide sensor 60, the radon gas sensor 62, and the photocatalytic sensor 63 are electrically connected to the microcontroller 14 or microprocessor 50, which is electrically connected to a ventilation hood relay 66. As shown, the ventilation hood relay 66 is electrically connected to the fan 12, which is capable of selectively controlling its operation and speed.

In addition, the microcontroller 14 or microprocessor 50 is electrically connected to a gas range relay 68 and/or an electric range relay 70, which are connected to a gas solenoid 72 and electric range contactor 74 respectively. The gas solenoid 72 controls the flow of gas to a gas-operated stove/oven 18, or portion thereof, and the electric range contactor 74 controls the flow of electricity to an electrically powered stove/oven 18, or portion thereof.

As shown, the system 10 may also comprise a first current sensor 76, preferably positioned and electrically connected between the electric range contactor 74 and the electric stove portion 18. The first current sensor 76 monitors the flow of electric current between the electric range portion 18 and the electric range contactor 50, thus ensuring electricity therebetween has been turned off or tuned on appropriately. The system 10 may also comprise a gas flow sensor 78 that is preferably positioned between the gas solenoid 72 and the gas range 18. This sensor 72 monitors the flow of gas to the gas range 18, and portions thereof, thus ensuring that the flow of gas has been turned off or tuned on appropriately.

Furthermore, the system 10 may comprise an electrical outlet relay 80 that is electrically connected to a second electric contactor 82. The second electric contactor 82 is electrically connected to the electrical power outlet or outlets 20. The second electric contactor 82 controls the flow of electricity to the electrical outlets 20 and appliances 22. A second current sensor 83 may be positioned between the second electric contactor 82 and the electrical outlets 20 to ensure the flow of electricity therebetween is correct.

In a preferred embodiment, a signal is received by the microcontroller 14 or microprocessor 50 from the UFP sensor 54. If the microcontroller 14 or microprocessor 50 determines the signal to be below the threshold value, then the relay switches 68, 70 and 80 are positioned to allow the various appliances, i.e. the stove 18 and other appliances 22 to operate. However, if the microcontroller 14 or microprocessor 50 determines the signal to be above the threshold value, i.e. the particle count is above a certain level, then the electrical outlet relay 80, the gas range relay 68 and/or the electric range relay 70 is activated. Activation of these relays 68, 70 and 80, shuts off the gas and/or electric power to the appliances 18, 22 through the further activation of the gas solenoid 72 and electrical contactors 74, 82 respectively. At the same time, the speed of the fan 12 is increased to thereby increase the volume of air passing through the system 10 and thus ridding the air of the contaminants. After a period of time, the signal may be reassessed by the microcontroller 14 or microprocessor 50 to ensure contaminants within the air have been removed to a safe level for cooking operations. In addition, the speed of the fan 12 may be maximized to hasten the removal of contaminants from the air. In a preferred embodiment, the time interval between air samplings may last from about one second to about one minute, more preferably, the time interval may range from about 1 second to about 30 seconds.

In a preferred embodiment, a signal may be received from the smoke sensor 56, the natural gas sensor 58, the carbon monoxide sensor 60, the radon gas sensor 62, and the photocatalytic sensor 63 by the microcontroller 14 or microprocessor 50. If the signal is determined to be above a respective threshold level, i.e., a natural gas threshold level, a radon gas threshold level, a carbon monoxide threshold level, a photocatalytic threshold level and/or a smoke threshold level, the microcontroller 14 or microprocessor 50 triggers the electric range relay 70, the gas range relay 68 and the electrical outlet relay 80 such that the electricity or gas to these appliances 18, 22 is turned off and the appliances 18, 22 become inoperable.

Specifically, the electrical and gas relays 70, 68 activate the electrical contactors 74, 82 and the gas solenoid 72 respectively, which turns off the gas and electricity to the stove 18 and surrounding electrical outlets 20. At the same time, the ventilation fan relay 66 may be activated to turn on and increase the speed of the fan 12, thereby increasing air movement through the system 10 and ridding the air of contaminants. When the microprocessor 14 or microprocessor 50 determines that the signal or signals from the sensors, 56, 58, 60, 62, or 63 is above the established threshold level(s), the speed of the fan 12 may be maximized for a period of time ranging from about 1 second to 60 seconds. After which time, the gas and or electrical power to the stove 18 and surrounding electrical outlets 20 is restored.

In an additional embodiment, the signal from these additional sensors 56, 58, 60, 62 and 63 may be analyzed again to determine if the level of contaminants within the air has reached a level below the threshold level. Once it is determined that the threshold level is achieved, through operation of the fan 12, the ventilation side opening 36 and/or filtration subassembly 24, the gas and/or electrical power to the stove 18 and surrounding electrical outlets 20 is restored.

In a preferred embodiment, the microcontroller 14 or microprocessor 50 may transmit a wireless signal 84 that activates the relay switches 66, 70 (FIGS. 1 and 10). Activation of the relay switches 66, 70 thus activates the oven 18 and electrical outlet 20 shutoff mechanisms. Specifically, when the microcontroller 14 or microprocessor 50 determines that the gas or electricity to the stove 18 or the electricity to the electrical power outlets 20 are to be turned off, the wireless signal 84 may be transmitted by a wireless transmitter 86. The wireless transmitter 86 may be positioned within the ventilation hood 26, particularly the plenum portion 28 of the hood 26, or alternatively, the transmitter 86 may be attached to a side panel of the ventilation hood 26 or positioned in a remote location within the food preparation area. A wireless receiver 88 located at a position distal of the wireless transmitter 86, receives the wireless signal 84 and activates the shut off mechanisms, such the gas solenoid 72 and/or the electrical contactors 74, 82. The wireless signal 84 may comprise a radio frequency (RF) signal or a magnetic induction signal.

In a further embodiment of the present invention, a signal to actuate and/or deactivate the respective shutoff mechanisms 90 may be provided by a device that utilizes the X10 communication protocol. The X10 communication protocol utilizes the power line and internal electrical wiring within a dwelling to transmit an X10 signal. In a preferred embodiment, a transmitting X10 device is utilized to transmit the X10 signal through the wiring of the dwelling that activates the shutoff mechanism 90, particularly the electrical outlet relay 80. A corresponding X10 receiving device may be used to receive the X10 signal. In addition, the X10 communication protocol may utilize the wireless transmitter 86 and the wireless receiver 88 in transmitting the X10 signal and/or the wireless signal 84.

Alternatively, the ventilation system 10 may be activated through detection of the intended use of the stove 18 or other food preparation appliances 22. In this embodiment, the microcontroller 14 or microprocessor 50 detects the intended use of the stove 18 and/or appliances 22 through the detection of the flow of gas and/or electrical current to the stove 18 and/or kitchen appliances 22 within the kitchen preparation area. More specifically, the system 10 may detect the initial flow of gas or electricity to the stove 18 as well as the surrounding electrical outlets 20 through monitoring of the signals from the gas flow sensor 78, the first current sensor 76, and the second current sensor 83. Once the flow of gas and/or electrical is detected by the microcontroller 14 or the microprocessor 50, the signal from the various sensors 54, 56, 58, 60, 62 and 63 is analyzed. If the sensor signal is above the threshold level, the flow of gas and electricity to the stove 18 and appliances 22 is shutoff for a predetermined period of time and the fan speed is increased to rid the air of contaminants.

In yet another alternate embodiment, the system 10 may automatically shut off the gas and/or electricity when the flow of gas and/or electricity, powering the stove 18 and appliances 22 is detected. In this embodiment, once the microcontroller 14 detects the initial flow of gas and/or electricity through the gas flow sensor 78, the first current sensor 76, and/or the second current sensor 83, the microcontroller 14 or microcontroller 50 activates the respective gas solenoid 72 and electrical contactors 74, 82 to turn off the electricity and/or gas for a period of time. At the same time, the ventilation fan relay 66 is activated to increase the speed of the fan 12, particularly to a maximum level, to rid the air of contaminants. Once the period of time has passed, i.e., from about 1 second to about 60 seconds, the gas solenoid 72 and electrical contactors 74, 82, powering the stove 18 and appliances 22, are turned back on.

As shown in FIG. 1, a stove shut off mechanism 90 is provided by the system 10. In a preferred embodiment, the stove shutoff mechanism 90 comprises a mechanical mechanism. Although a mechanical stove shutoff mechanism is preferred, a pneumatic or an electrical stove shut off mechanism may also be used with the system 10. Furthermore, the stove shutoff mechanism 90 may be designed to shut off an electric and/or gas powered stove 18. Examples of such over shutoff mechanisms are disclosed in U.S. Pat. Nos. 4,813,487 and 4,979,572, both to Mikulec et al., the disclosures of which are incorporated herein by reference. In an embodiment, the microcontroller 14 or microprocessor 50 may activate a microswitch 92 (FIG. 3) that transmits the wireless signal 84 that activates these mechanical or electrical stove shutoff mechanisms.

As shown in FIGS. 1 and 10, the sensors 54, 56, 58, 60, 62 and 63 may be electrically connected to an alarm 94. The alarm 94 may be of an audible or visual alarm such that it emits an audible or visual alert signal. The alarm 94 may be electrically connected to the micro-switch 92, the microprocessor 50 or the electric outlet relay switch 80 such that in the event that the ventilation system 10 detects the presence of smoke, natural gas, carbon monoxide, radon gas or the like, the alarm 94 is activated emitting an audible alarm sound and/or a visible alarm indictor is shown. Such an alarm signal may be connected to a burglar alarm system (not shown).

In addition, the ventilation system 10 may be designed such that when the alarm 94 is activated, a signal is sent to a remote location such as a central control room, a fire station, a police station, or other first response station. This signal may be sent through a dedicated hard wire line, a telephone landline, or via a wireless mobile phone. It is further contemplated that such a signal may be transmitted through an X10 communication protocol, as previously described, or via the wireless transmitter 86.

As illustrated in FIGS. 1 and 10, the system 10 may also comprise a motion sensor 96 such that when the stove or over 18 is on for a prescribed amount of time, such as from about 1 minute to about 30 minutes, and no motion has been detected, the alarm 94 of the system 10 may be activated. In addition, a video camera 98 and/or microphone 100 may also be connected within the system 10. The image and audio inputs from the video camera 98 and/or the microphone 100 may also be used to detect motion next to the stove 18 and thus be incorporated into the operation of the alarm 94.

As previously mentioned, the ventilation system 10 of the present invention may comprise an air purification subassembly 24. In a preferred embodiment, the subassembly 24 comprises at least a filtration screen 102 and a carbon filter 104. The carbon filter 104 is enclosed by a filtration housing 106. The filtration screen 102 is preferably positioned adjacent to the air intake opening 30 of the fan 12. In a preferred embodiment, the filtration screen 102 is positioned such that the contaminated air 34 flows through the filtration screen 102 into the fan housing 48 and is circulated by the impellor 46 of the fan 12. The impellor 46 propels the air through the filtration sub-assembly 24. In a preferred embodiment, the filtration screen 102 is composed of a metal such as stainless steel. Alternatively, the filtration screen 102 may be composed of graphene or coated with a layer of titanium oxide or graphene. Additional filters such as a hepa filter 108 and a glass mesh filter 110 may also be integrated within the purification subassembly 24 within the filtration housing 106.

Figure 5:
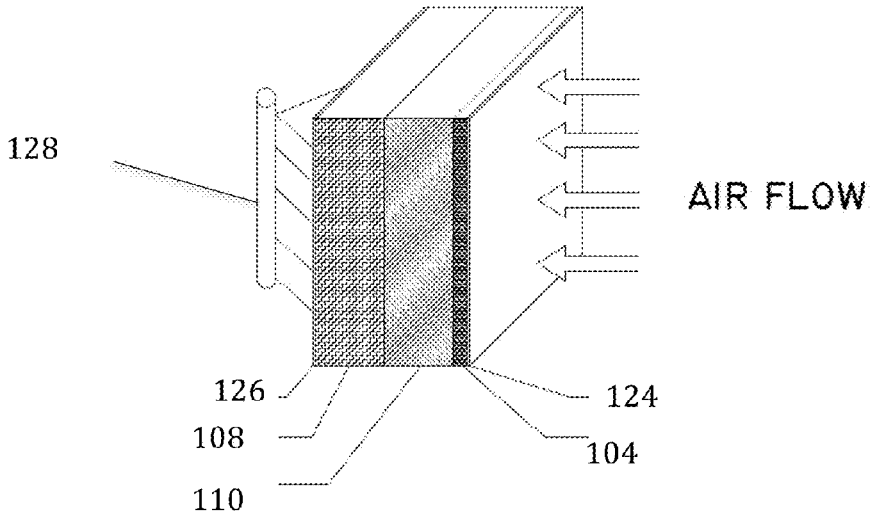
FIG. 5 shows a magnified perspective view illustrating an embodiment of the filters that comprise the filtration compartment.

FIGS. 2, 3 and 5 illustrate an embodiment of the purification subassembly 24 of the ventilation system 10 positioned within the ventilation hood 26. As shown in FIG. 2, two purification compartments 112A, 112B are positioned within the plenum portion 28 of the hood 26. In the illustrated embodiment, the impellor 46 is positioned therebetween such that contaminated air 34 may enter each of the compartments 112A, 112B. Although two filtration compartments 112 are illustrated, the ventilation system 10 may comprise at least one compartment 112 positioned within the hood 26. Furthermore, the filtration compartment or compartments 112 of the filtration subassembly 24 may be positioned in a multitude of locations within the plenum portion 28 of the ventilation hood 26. For example, the compartment 112 may be positioned to the right or left of the fan 12 as well as in the front or back of the ventilation hood 26. Furthermore, the filtration compartment 112 may be positioned circumferentially around the impellor 46 of the fan 12. In either case, the ventilation sub assembly 24 is designed such that the fan 12 forces the contaminated air 34 therewithin. Although the filtration compartment 112 is shown with a rectangular cross-section, the compartment 112 may be designed having a cross-sectional shape of a multitude of polygons including but not limited to, a triangular, a curve, a circle, a hexagon, a square, or the like.

FIGS. 6, 9A and 9B illustrate embodiments of the airflow through the fan 12 and the system 10. As illustrated, the impellor 46 rotates within the fan housing 48. In a preferred embodiment, contaminated air 34 enters the air intake opening 30 and exits either through an air exit opening 114 within a sidewall of the fan housing 48 (FIG. 9A) or is circulated through the filtration subassembly 24 (FIG. 9B). More specifically, in one embodiment of airflow within the system 10 as shown in FIG. 9A, contaminated air 34 enters through the air intake opening 30 and directly exits the side opening 36 of the ventilation hood 26, thus exiting the system 10 and the dwelling. As shown, the side opening 36 is positioned through a back sidewall of the ventilation hood 26, however, the side opening may be positioned through a top sidewall 138, a left sidewall 140 or a right sidewall 142 of the ventilation hood 26, thus exiting the system 10 and the dwelling.

Figure 8:
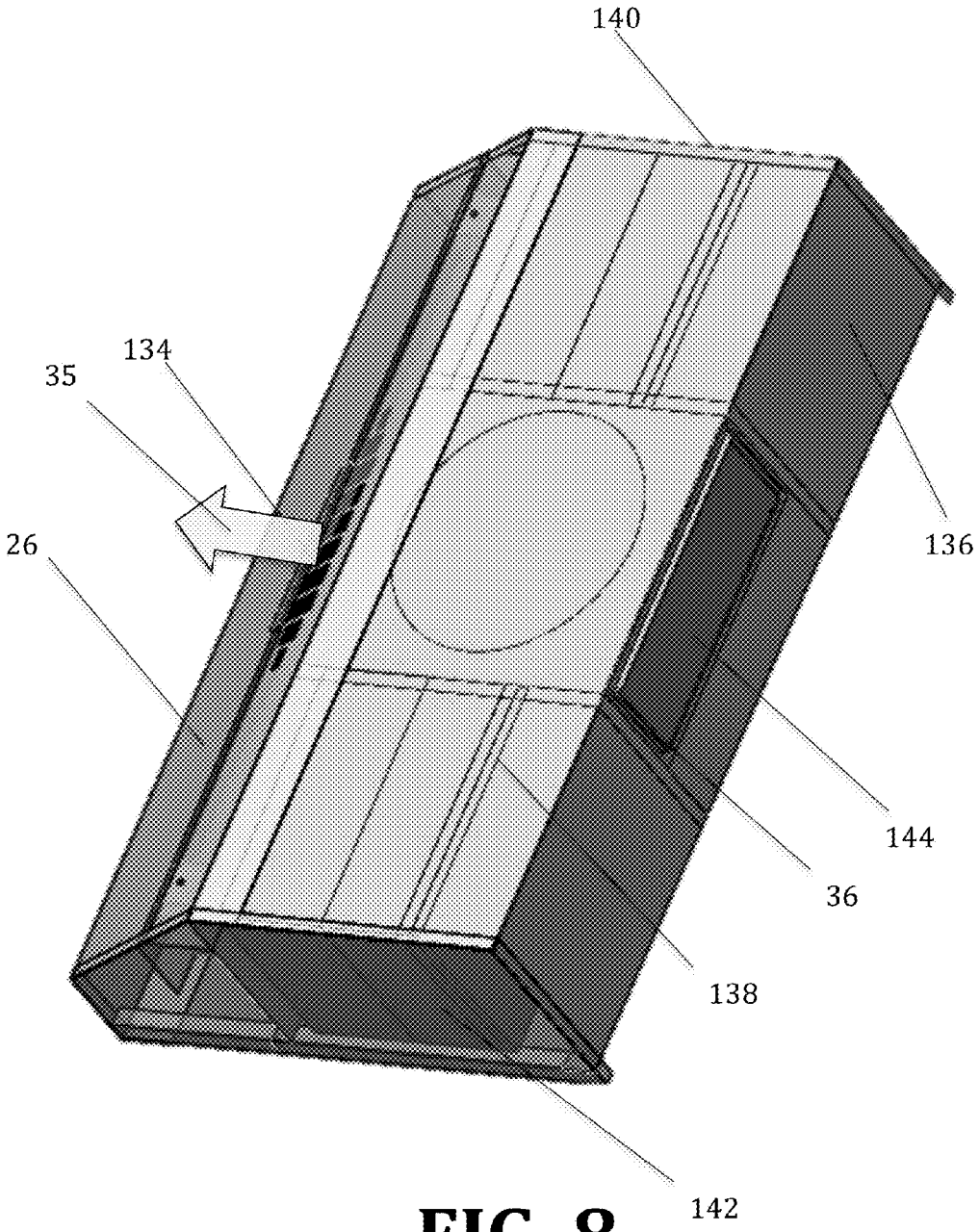
FIG. 8 shows a perspective view of an embodiment of the topside of the air filtration system of the present invention in a ventilation hood.

Alternatively, in another embodiment, as shown in FIG. 9B, contaminated air 34 enters through the air intake opening 30, passes through the filtration subassembly side openings 132 and circulates through the air filtration compartment or compartments 112. In this alternate embodiment, the contaminated air 34 is not exited out the side opening 36 of the ventilation hood 28 but rather is circulated through the filtration subassembly 24 and exists out as purified air 35 through a ventilation hood exit opening 134 as shown in FIGS. 8 and 9B.

Airflow through the ventilation system 10, whether air 34 is directed through the filtration subassembly 24 or is immediately exited out the ventilation hood side opening 36, is primarily determined by the microcontroller 14 or microprocessor 50. In a preferred embodiment, the system 10 may further comprise a filtration subassembly side opening latch 133 as well as a ventilation hood side opening latch 37. The filtration subassembly side opening latch 133 is generally positioned adjacent the filtration subassembly side openings 132 and the ventilation hood side opening latch 37 is generally positioned adjacent the ventilation hood side opening 36 or alternatively on a portion of a ventilation side door 144. These latches 37, 133, may comprise a magnetic or a electro-magnet or a spring hinge mechanism that controls airflow through the filtration side opening 132 and ventilation hood opening 36 respectively. For example, the filtration subassembly side opening latch 133 may control the opening and closing of a filtration subassembly side door that slides back and forth in front of or in back of the openings 132. Alternatively, the subassembly filtration side opening latch 133 may control the opening and closing of individual door portions that cover the openings 132. In either case, the microcontroller 14 or microprocessor 50 preferably controls the opening and closing of the filtration subassembly openings 132. Furthermore, the microcontroller 14 or microprocessor 50 may also control the opening and closing of the ventilation side opening 36 through the activation or deactivation of the ventilation hood side opening latch 37.

In a preferred embodiment, when contamination is detected by the sensors 54, 56, 58, 60 or 62, that is determined to be above the respective threshold levels, the microcontroller 14 or microprocessor 50 activates the filtration subassembly side opening latch 133 such that the filtration subassembly side openings 132 are closed, thereby preventing airflow through the filtration subassembly 24. In addition, the microcontroller 14 or microprocessor 50 activates the ventilation hood side opening latch 133 such that the ventilation hood side opening 36 is open for the contaminated air 34 to pass therethrough. Furthermore, when contamination is detected, the speed of the fan impellor 46 is increased to rid the contaminated air from the system 10. Once the level of contaminants is determined to be below the respective threshold levels, the microcontroller 14 or microprocessor 50 deactivates the filtration subassembly side opening latch 133 such that air may pass through the filtration subassembly openings 132 and through the air filters. In addition, the microcontroller 14 or microprocessor 50 may activate the ventilation hood latch mechanism 37 such that the ventilation side opening door 144 is closed thereby preventing airflow through the ventilation side opening 36. In a preferred embodiment, airflow through the system 10 is either exited out the ventilation side opening 36 or is circulated through the filtration subassembly 24. Preferably, air does not flow through the ventilation side opening 36 and the filtration subassembly 24 at the same time.

In addition to controlling the activation and deactivation of the latch mechanisms 133, 37, the microcontroller 14 or microprocessor 50 may also adjust the speed of the fan 12 to control the opening and closing of the filtration side openings 132 and/or the ventilation hood opening 36. Specifically, air pressure generated from the increased speed of the fan 12, opens the ventilation hood side opening 36. Specifically, an air velocity within the ventilation hood 26 is achieved such that the door portion 144 covering the opening 36 is moved thereby allowing the contaminated air to exit. Furthermore, the filtration subassembly openings 132 may be designed such that the increased velocity of the air within the system 10 causes the openings 132 to close. Once the velocity of the air within the ventilation hood 26 is reduced, the door portion 144 covers the opening 36 thereby preventing air from escaping the opening 36. Thus, when air contamination is detected, the increased speed of the fan 12 forces the contaminated air 34 out the ventilation hood opening 36 bypassing the filtration subassembly 24. Likewise, when the air is determined to have a contamination level below the respective threshold levels, the fan speed is reduced, thereby closing the door portion 144 of the ventilation hood opening 36 and opening the filtration subassembly openings 132. Thus, the system 10 of the present invention provides an automatic dynamic filtration system such that air of increased contamination levels is exhausted from the food preparation area quickly and efficiently and air having a reduced level of contamination is circulated through the filtration subassembly 24 and is returned to the food preparation area is purified air 35.

Figure 4:
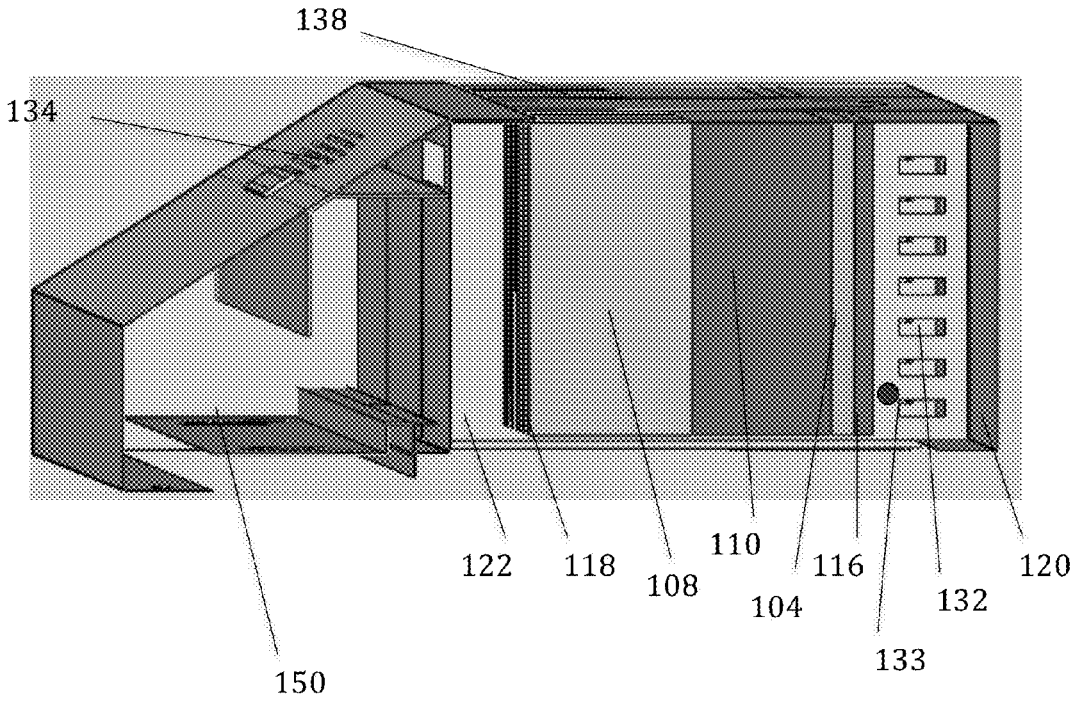
FIG. 4 is a cross-sectional view taken along a longitudinal axis of FIG. 3 illustrating an embodiment of the components comprising the air purification subassembly.

FIG. 4 illustrates a cross-sectional view of an embodiment of the filtration compartment. As shown, the compartment 112 comprises a distal end portion 116 spaced from a proximal end portion 118, the distal end 116 positioned adjacent a back side 120 of the ventilation hood 26 and the proximal end portion 118 of the compartment 112 positioned adjacent a front side 122 of the ventilation hood 26.

FIG. 5 illustrates an isolated perspective view of the filtration subassembly 24. In the example shown, a first filtration mesh 124 is positioned about the distal end 116 of the compartment 112. The carbon filter 104 is preferably positioned adjacent and proximal of the first filtration mesh 124. As shown, the glass mesh filter 110 may be positioned adjacent and proximal of the carbon filter 104. The hepa filter 108 is positioned adjacent and proximal of the glass mesh filter 110 and a second filtration mesh 126 may be positioned adjacent and proximal of the hepa filter 108. It is noted that the carbon filter 104, the hepa filter 108, the glass filter 110 and the first and second screen meshes 124, 126 may be positioned in a multitude of non-limiting sequential orders. For example, the hepa filter 108 may be positioned within the filtration compartment 112, distal of the carbon filter 104 and additional screen meshes may also be used. Furthermore, the filters 104, 108, 110 and screen meshes 124, 126 may be designed in a modular construction such that each individual filter 104, 108, 110 and/or screen mesh 124, 126 may be removed separately and re-installed in the filtration compartment 112.

In a preferred embodiment, the carbon filter 104 may comprise activated carbon, granulated carbon or combinations thereof. In addition, the carbon filter 104 may comprise graphene, either in pellet or power form residing therewithin. Furthermore, a portion of the carbon filter 104 may comprise a mixture of carbon and a polymeric material such as polypropylene or polyethylene. In a preferred embodiment, the portion of the polymeric material may be interwoven within the carbon material such as in a pad or fabric form.

In a preferred embodiment, the carbon filter 104 and the first screen mesh 124 are designed to promote the formation of an electro static charge therewithin that removes particulate contaminants from the air. Preferably, the first screen mesh 124, and interwoven carbon and polymeric material within the carbon filter 104 work in concert to generate the static electric charge that removes the particulates from the air. Alternatively, the filtration subassembly 24 may be electrically connected to the power source 52 thereby creating an electrostatic charge therewithin that forces the air to pass through the series of filters and screens.

The carbon filter 104 may have a thickness ranging from about 0.5 inches to about 5 inches. Likewise, the hepa filter 108 may have a thickness ranging from about 0.5 inches to about 5 inches. In an embodiment, the filtration subassembly 24 may comprise more than one of each of the filters 104, 108, 110. Furthermore, the filtration subassembly 24 may be designed with any number or combinations of the filters and filter mesh screens 104, 108, 110, 124 and 126. For example, the filtration subassembly 24 may comprise the carbon filter 104 and glass filter 110. In another embodiment, the subassembly 24 may comprise the carbon filter 104 and the hepa filter 108. Furthermore, an antimicrobial coating may be applied to the surfaces of the filters 104, 108, 110 and/or an interior surface of the filtration housing 106.

As shown in FIGS. 3 and 5, an ultra violet (UV) light source 128 is positioned at the proximal end 118 of the filtration compartment 112. The ultra violet light source 128 works in conjunction with the second filtration mesh 126 to provide a photocatalytic process whereby microorganisms and viruses that may be present within the air are destroyed. In a preferred embodiment the first and second filtration meshes 124, 126 are composed of a metal such as stainless steel. An exterior coating of titanium oxide, graphene or combinations thereof may be applied to the first screen mesh 124 or second screen mesh 126. Furthermore a layer of titanium oxide, graphene and combinations thereof may be applied to the exterior surfaces of the hepa filter 108, the carbon filter 104 and/or the glass filter 110.

The titanium oxide coating, in combination with the ultra violet light, initiates the photocatalytic process. In addition, the interior and/or exterior surfaces of the filtration housing 106 may also be coated with titanium oxide or graphene to promote the photocatalytic process. Likewise, at least a portion of an interior surface of the ventilation hood 26 may also be coated with titanium oxide and/or graphene. Furthermore, the fan speed may be modified to adjust the volume and velocity of the air moving through the series of filters 104, 108, 110.

In a preferred embodiment, the air speed may be reduced in a cyclical manner such that the exposure time of the air to the UV light source 128 and the second screen mesh 126 is increased. For example, the speed of the air may be reduced to below 5 CFM for a period of time ranging from a 1 sec to about 5 seconds, at which time, the CFM of the air through the filtration compartment 112 is increased. The UV light source 128 may be controlled by the microcontroller 14 such that it turns on and off at prescribed times or programmable sequences.

In addition, the photocatalytic sensor 63 (FIG. 3) may monitor the photocatalytic process and provide information regarding the photocatalytic process to the microcontroller 14. This information may cause the microcontroller 14 to modify the intensity of the UV light source 128 and/or activate the shutoff mechanisms 90 comprising the electric range relay 70, gas range relay 68, electrical outlet relay 80, ventilation fan relay 66, electric range contactor 74, electrical outlet contactor 82, or gas solenoid 72.

The filtration compartment 112 is constructed in a sealed tight manner such that air does not leak out of the compartment 112. A seal 130 may be positioned around the compartment 112 and housing 106 to prevent the undesirable leakage of air either moving in or out of the compartment 112. In a preferred embodiment, a backpressure of air is created within the compartment 112. It is this backpressure of air that allows the air to circulate through the system 10. As shown in FIG. 7, the contaminated air 34 enters the air intake opening 30 of the fan 12. Air is circulated by the fan 12 and enters the distal end 116 of the filtration compartment 112. As shown, the contaminated air 34 proceeds through a series of air filtration subassembly side openings 132 within the filtration housing 106. The air then travels from the distal end 116 of the filtration compartment 112 through the series of filters 104, 108, 110 and screen meshes 124, 126 to the proximal end 118 of the compartment 112. The filtered air 35 then exists the ventilation system 10 through the ventilation hood exit opening 134 shown in FIGS. 1 and 8.

In an embodiment, the ventilation system 10 of the present invention may comprise a series of status lights 146, which indicate the operational condition of the system 10. A light may be displayed in the event that a system failure has occurred such as a malfunctioning relay or sensor malfunction. In addition, a light may be displayed in the event that a contaminant is detected. For example, if ultra fine particles are detected a yellow light may be displayed, if natural gas is detected, a red light may be displayed, etc. Furthermore, the status light or lights 146 may operate in response to the operation mode of the system 10. For example, the status light or lights 146 may turn on or off, or change color and/or intensity based on the speed of the fan 12 or if there is a malfunction with the system 10.

In an embodiment, as shown in FIG. 1, the ventilation system 10 of the present invention may also comprise a fire suppression system 148. The fir suppression system 148 is also designed to reside within the ventilation hood 26. Specifically, the fire suppression system 148 may reside within the plenum portion 28 or a canopy portion 150 of the ventilation hood 26. Embodiments of various fire suppression systems and related apparatus are described in U.S. Pat. Nos. 4,756,839, 4,813,487, 4,979,572, 5,992,531, and 7,303,024, all to Mikulec and are incorporated by reference herein.

The fire suppression system 148 may operate independently or may be connected to the microcontroller 14 or microprocessor 50. The fire suppression system 148 comprises an actuator mechanism, which operates mechanically, electrically or pneumatically. In a preferred embodiment, the fire suppression system 148 further comprises a container within which is positioned a fire extinguishing material and a rod ejection mechanism.

In addition, the ventilation system 10 may comprise a temperature sensor 152 that is electrically connected to the microcontroller 14 or microprocessor 50. In the event that a temperature is detected, for example, that exceeds a predetermined temperature, for example, 200° F., the microcontroller 14 or microprocessor 50 may activate the gas and electrical shutoff mechanisms 90. In addition, the microcontroller 14 may increase the speed of the fan 12. Furthermore, the microcontroller 14 may send an alert signal to the first responder station. Moreover, when the set temperature is exceeded, the microcontroller 14 may activate the fire suppression system 148.

In a preferred embodiment, the temperature sensor 152 may work in conjunction with input from the video camera 98 and/or the microphone 100. More specifically, information from the various input signals from the temperature sensor 152, the video camera 98 and/or the microphone 100 can be analyzed by the microcontroller 14 or microprocessor 50 to determine if there is a possible imamate danger of a fire thereby requiring activation of the fire suppression system 148 and/or the alarm 94. For example, if motion or sound has not been detected for approximately 5 to 60 minutes, and the temperature above the stove 18 is increasing to a cautionary temperature range of between about 100° F. to about 150° F., then the alarm 94 may be activated. If the temperature continues to rise into a critical temperature range above 150° F., then the fire suppression 148 may be activated to preemptively prevent a fire from occurring.

The attached drawings represent, by way of example, different embodiments of the subject of the invention. Multiple variations and modifications are possible in the embodiments of the invention described here. Although certain illustrative embodiments of the invention have been shown and described here, a wide range of modifications, changes, and substitutions is contemplated in the foregoing disclosure. In some instances, some features of the present invention may be employed without a corresponding use of the other features. Accordingly, it is appropriate that the foregoing description be construed broadly and understood as being given by way of illustration and example only, the spirit and scope of the invention being limited only by the appended claims.

What is claimed is:

1. A ventilation system, comprising:

a) a microcontroller electrically connectable to an electrical power supply;

b) an impellor capable of variable speed operation electrically connectable to the microcontroller and the power supply;

c) a sensor capable of emitting a measurable sensor signal electrically connectable to the microcontroller and the power supply;

d) a filtration subassembly comprising a filter positioned within a filtration housing positionable adjacent the impellor;

e) a stove shutoff mechanism activatable when a sensor threshold value is exceeded;

f) an electrical outlet shutoff mechanism activatable when the sensor threshold value is exceeded; and g) wherein actuation of the stove shutoff mechanism and/or the electrical outlet shutoff mechanism occurs when the sensor signal has exceeded the sensor threshold value.

2. The system of claim 1 wherein the sensor is selected from the group consisting of an ultra fine particle sensor, a temperature sensor, a smoke sensor, a carbon monoxide sensor, a natural gas sensor, a radon gas sensor, and combinations thereof.

3. The system of claim 1 wherein the speed of the impellor increases when the sensor signal has exceeded the signal threshold value.

4. The system of claim 1 wherein the sensor signal is an electrical voltage ranging from about 0.01 mV to about 100 mV.

5. The system of claim 1 wherein the filter is selected from the group consisting of a carbon filter, a hepa filter, a glass filter, and combinations thereof.

6. The system of claim 5 wherein the carbon filter comprises activated carbon, granulated carbon, a polymeric material, graphene or combinations thereof.

7. The system of claim 5 wherein an antimicrobial coating resides on at least a portion of an exterior surface of the carbon filter, the hepa filter, or the glass filter.

8. The system of claim 1 wherein a UV light source is positionable within a ventilation hood adjacent the filtration subassembly.

9. The system of claim 8 wherein the UV light source and a screen mesh of the filtration subassembly are capable of initiating a photocatalytic process wherein microorganisms and viruses present in the surrounding air are destroyed.

10. The system of claim 1 wherein the microcontroller, the power supply, the impellor, and the filtration subassembly reside within a ventilation hood.

11. The system of claim 10 wherein a layer of titanium oxide resides on at least a portion on an interior surface of the ventilation hood.

12. The system of claim 10 wherein a side opening resides through a thickness of a panel portion of the ventilation hood.

13. The system of claim 1 wherein the stove shutoff mechanism comprises a gas relay switch, an electric range relay switch, a gas solenoid, a gas flow sensor, an electric range contactor, a first current sensor and combinations thereof.

14. The system of claim 1 wherein the electrical outlet shutoff mechanism comprises an electric outlet relay, an electric outlet contactor, a second current sensor and combinations thereof.

15. The system of claim 1 wherein when the sensor signal is determined to be below the signal threshold value, the stove shutoff mechanism and the electrical outlet shutoff mechanisms are deactivated such that the flow of gas and electricity to the stove and electrical outlets are restored.

16. The system of claim 1 wherein when the sensor signal is determined to be below the signal threshold value, the speed of the impellor is reduced.

17. The system of claim 1 wherein after a period of time ranging from about 1 second to about 60 seconds has passed, the stove shutoff mechanism and the electrical outlet shutoff mechanisms are deactivated such that the flow of gas and electricity to the stove and electrical outlets is restored.

18. The system of claim 1 wherein after a period of time ranging from about 1 second to about 60 seconds has passed, the speed of the impellor is decreased 19. The system of claim 1 wherein a first screen mesh is positionable at a distal end of the filtration subassembly and a second screen mesh is positionable adjacent a proximal end of the filtration subassembly.

20. The system of claim 19 wherein the first and second screen meshes comprise stainless steel or graphene.

21. The system of claim 19 wherein the first and second screen meshes comprise an exterior coating of titanium oxide or graphene.

22. The system of claim 1 wherein an alarm is activatable by the microcontroller.

23. The system of claim 1 wherein the stove shutoff mechanism comprises a mechanical, an electrical, a pneumatic gas, and/or an electrical shutoff mechanism.

24. The system of claim 1 wherein the electrical outlet shutoff mechanism comprises a mechanical or an electrical mechanism.

25. The system of claim 1 wherein the stove shutoff and/or the electrical outlet shutoff mechanisms are actuatable by an X10 communication protocol signal.

26. The system of claim 1 further comprising a camera capable of providing a video signal, a microphone capable of providing an audio signal, a motion sensor capable of providing a motion sensor signal, a wireless transmitter capable of transmitting a wireless signal, a wireless receiver capable of receiving a wireless signal and combinations thereof.

27. The system of claim 1 wherein the stove shutoff and/or the electrical outlet shutoff mechanisms are actuatable via a wireless signal.

28. The system of claim 26 wherein the stove shutoff mechanism and/or the electrical outlet shutoff mechanism are actuatable when the microprocessor receives an input from the video signal, the audio signal, the motion sensor signal or combinations thereof.

29. The system of claim 1 wherein a fire suppression system is provided in a canopy portion of a ventilation hood.

30. The system of claim 29 wherein actuation of the fire suppression system occurs when the sensor threshold value is exceeded.

31. The system of claim 1 wherein actuation of a latch mechanism controls the independent opening and closing of a ventilation side hood opening and/or a filtration subassembly opening.

32. A safety system comprising:

a) a microcontroller electrically connectable to an electrical power supply;

b) a sensor capable of emitting a measurable sensor signal electrically connectable to the microcontroller and the power supply;

c) a stove shutoff mechanism activatable when a sensor threshold value is exceeded;

d) an electrical outlet shutoff mechanism activatable when the sensor threshold value is exceeded; and e) wherein actuation of the stove shutoff mechanism and/or the electrical outlet shutoff mechanism occurs when the sensor signal is determined to have exceeded the signal threshold value.

33. The system of claim 32 wherein the sensor is selected from the group consisting of an ultra fine particle sensor, a smoke sensor, a temperature sensor, a carbon monoxide sensor, a natural gas sensor, a radon gas sensor, and combinations thereof.

34. The system of claim 32 wherein the sensor signal is an electrical voltage ranging from about 0.01 mV to about 100 mV.

35. The system of claim 32 wherein the microcontroller and the power supply reside within a ventilation hood.

36. The system of claim 35 wherein the ventilation hood comprises a side opening residing through a thickness of a side panel portion of the hood.

37. The system of claim 35 wherein a layer of titanium oxide resides on at least a portion of an interior surface of the ventilation hood.

38. The system of claim 32 wherein when the sensor signal is determined to be below the signal threshold value, the stove shutoff mechanism and the electrical outlet shutoff mechanisms are deactivated such that the flow of gas and electricity to a stove and electrical outlets are restored.

39. The system of claim 32 wherein after a period of time ranging from about 1 second to about 60 seconds has passed, the stove shutoff mechanism and the electrical outlet shutoff mechanisms are deactivated such that the flow of gas and electricity to a stove and electrical outlets are restored.

40. The system of claim 32 wherein an alarm is activatable by the microcontroller.

41. The system of claim 32 wherein a filtration subassembly comprising a filter is positionable within a ventilation hood.

42. The system of claim 41 wherein the filter is selected from the group consisting of a carbon filter, a hepa filter, a glass filter, and combinations thereof.

43. The system of claim 41 wherein the filtration subassembly comprises a UV light source.

44. The system of claim 43 wherein the UV light source and a screen mesh of the filtration subassembly are capable of initiating a photocatalytic process wherein microorganisms and viruses present in the surrounding air are destroyed.

45. The system of claim 32 wherein the stove shutoff mechanism comprises a gas relay switch, an electric relay switch, a gas solenoid, a gas flow sensor, a first current sensor, an electric range contactor or combinations thereof.

46. The system of claim 32 wherein the electrical outlet shutoff mechanism comprises an electric outlet relay, an electric outlet contactor, a second current sensor and combinations thereof.

47. The system of claim 32 wherein the stove shutoff mechanism comprises a mechanical or an electrical mechanism.

48. The system of claim 32 wherein the electrical outlet shutoff mechanism comprises a mechanical or an electrical mechanism.

49. The system of claim 32 wherein the stove shutoff and/or the electrical outlet shutoff mechanisms are actuatable by an X10 communication protocol signal.

50. The system of claim 32 further comprising a camera capable of providing a video signal, a microphone capable of providing an audio signal, a motion sensor capable of providing a motion sensor signal, a wireless transmitter capable of transmitting a wireless signal, a wireless receiver capable of receiving a wireless signal and combinations thereof.

51. The system of claim 32 wherein the stove shutoff and/or the electrical outlet shutoff mechanisms are actuatable via a wireless signal.

52. The system of claim 50 wherein the stove shutoff mechanism and/or the electrical outlet shutoff mechanism are actuatable when the microprocessor receives an input from the video signal, the audio signal, the motion sensor signal or combinations thereof.

53. The system of claim 32 wherein a fire suppression system is provided in a canopy portion of a ventilation hood.

54. The system of claim 53 wherein actuation of the fire suppression system occurs when the sensor threshold level is exceeded.

55. A method of operating a ventilation system, the method comprising the steps of:

a) providing a ventilation system comprising:
   i) a microcontroller electrically connectable to an electrical power supply;
   ii) an impellor capable of variable speed operation electrically connectable to the microcontroller and the power supply;
   iii) a sensor capable of emitting a sensor signal electrically connectable to the microcontroller and the power supply;
   iv) a filtration subassembly comprising a filter positioned within a filtration housing;
   v) a stove shutoff mechanism activatable when a sensor threshold value is exceeded; and
   vi) an electrical outlet shutoff mechanism activatable when the sensor threshold value is exceeded;

b) measuring the sensor signal;

c) determining whether the sensor signal exceeds the sensor threshold value; and d) activating the stove shutoff mechanism and the electrical outlet shutoff mechanism when the sensor signal exceeds the sensor threshold value.

56. The method of claim 55 including increasing a speed of the impellor when the sensor signal exceeds the sensor threshold value.

57. The method of claim 55 including deactivating the stove shutoff mechanism and the electrical outlet shutoff mechanism when the sensor signal is below the sensor threshold value, such that the flow of gas and electricity are restored.

58. The method of claim 55 including waiting a period of time ranging from about 1 second to about 60 seconds, after which the stove shutoff mechanism and the electrical outlet shutoff mechanisms are deactivated such that the flow of gas and electricity are restored.

59. The method of claim 55 including providing the sensor selected from the group consisting of an ultra fine particle sensor, a smoke sensor, a carbon monoxide sensor, a natural gas sensor, a radon gas sensor, and combinations thereof.

60. The method of claim 55 including providing the sensor signal is an electrical voltage ranging from about 0.01 mV to about 100 mV.

61. The method of claim 55 including providing the filter selected from the group of filters consisting of a carbon filter, a hepa filter, and a glass filter.

62. The method of claim 61 including providing the carbon filter comprising activated carbon, granulated carbon, graphene, or combinations thereof.

63. The method of claim 55 including providing a UV light within a ventilation hood adjacent a proximal end of the filtration subassembly.

64. The method of claim 55 including providing a first screen mesh positioned at a distal end of the filtration subassembly and a second screen mesh positioned adjacent a proximal end of the filtration subassembly.

65. The method of claim 64 including providing the first and second screen meshes comprising stainless steel or graphene.

66. The method of claim 64 including providing the first and second screen meshes having an exterior coating of titanium oxide or graphene.

67. The method of claim 55 including providing the stove shutoff mechanism comprising a gas relay switch, an electric relay switch, a gas solenoid, a gas flow sensor, an electric range contactor, a first current sensor and combinations thereof.

68. The method of claim 55 including providing the electrical outlet shutoff mechanism comprising an electrical outlet shutoff relay switch, an electrical outlet contactor, a second current sensor and combinations thereof.

69. The method of claim 55 including providing a wireless signal that activates the stove shutoff and/or the electrical outlet shutoff mechanisms.

70. The method of claim 55 including providing a fire suppression system provided in a canopy portion of a ventilation hood.

* * * * *